United States Patent [19]

Wolf et al.

[11] Patent Number: 4,732,227

[45] Date of Patent: Mar. 22, 1988

[54] EQUIPMENT FOR CONTINUOUS HOLE DRILLING IN SOIL

[75] Inventors: Dan Wolf, Haifa; Avraham Steif, Kiriat-Bialik; Arie Wolk; Gedalia Manor, both of Haifa, all of Israel

[73] Assignee: Technion Research & Development Foundation Ltd., Haifa, Israel

[21] Appl. No.: 946,191

[22] Filed: Dec. 23, 1986

[51] Int. Cl.[4] ..... E21B 3/02

[52] U.S. Cl. ..... 175/170; 175/203; 111/89

[58] Field of Search ..... 175/51, 113, 170, 203; 111/2, 6, 89, 99; 37/252

[56] References Cited

U.S. PATENT DOCUMENTS 3,224,512 12/1965 Alexander ..... 175/51
3,406,765 10/1968 Alexander ..... 175/51

FOREIGN PATENT DOCUMENTS 286377 1/1971 U.S.S.R. ..... 111/2
470267 8/1975 U.S.S.R. ..... 111/6
1116993 10/1984 U.S.S.R. ..... 111/2

*Primary Examiner*—Stephen J. Novosad
*Assistant Examiner*—Terry Lee Melius
*Attorney, Agent, or Firm*—Frishauf, Holtz, Goodman & Woodward

[57] ABSTRACT

Equipment for drilling a row of equidistant holes comprises a carriage attached to a tractor and two earth augers rotated about their axes by the tractor power-take-off through transmission means. The augers are fastened in opposite alignment to a horizontal axle which is mounted in bearings on the carriage and is rotated by one of the road wheels through a chain drive causing the two augers to rotate about the axle in a plane parallel to the direction of travel. The rotating augers enter the soil alternately and drill equidistant holes during progress of the tractor and the carriage.

18 Claims, 5 Drawing Figures

EQUIPMENT FOR CONTINUOUS HOLE DRILLING IN SOIL

BACKGROUND OF THE INVENTION

The invention relates to equipment adapted to drill a row of distanced-apart relatively shallow holes in the soil while travelling along at uniform speed, without stopping during drilling of each hole. The equipment is particularly useful in digging equidistant holes for planting of trees or erecting of fence posts.

The conventional equipment for drilling holes in the soil usually consists of a vehicle equipped with a vertical rotating earth-drill or auger attached to a boom which is adapted to lower and press the rotating drill into the soil and to pull it out of the drilled hole after its completion. The vehicle, preferably a tractor, is moved from hole to hole and has to remain in each place until the hole is completed, before moving to the next hole site. The drill is rotated by either hydraulic or mechanical transmission means operated by the tractor engine. The output of this kind of hole digger is between 40 to 100 holes per hour, under favorable circumstances.

It is, therefore, a main object of the invention to provide equipment capable of drilling hundreds of holes per hour while moving over the area at constant speed without stoppages.

It is another object of the invention to provide equipment for attachment to a tractor which should supply the power necessary for drilling the holes and simultaneously to pull the equipment across the field, or alternatively, to provide self-powered equipment to be drawn by any kind of traction vehicle capable of moving across agricultural land.

It is still another object to provide a drill that need not be lowered into the hole and to be lifted out after the operation, thereby saving considerable time and labor, and it is a final object to provide such equipment at reasonable cost.

SUMMARY OF THE INVENTION

The drilling equipment according to the invention comprises a carriage frame adapted for attachment to a traction vehicle and supported by at least one road wheel. At least one earth auger is mounted on the frame and is rotatable about its axis at a rotational speed compatible with earth drilling work, and revolvable about a horizontal axis in a plane parallel to the direction of travel at a rotational speed proportional to the speed of travel of the equipment. The auger is fastened to the output shaft of a gear transmission which is revolvably attached to the carriage in bearing means, while the gear transmission is driven by a power unit through mechanical or hydraulic transmission means. The gear transmission together with the auger is revolved by chain gear means connecting it to a road wheel, the latter being advantageously provided with peripheral spikes for better adhesion, so as to prevent its slipping on the ground.

The auger consists of a shank with one or more helical blades ending in a pair of cutting lips, hard cutting teeth being attached to the outer edges of the blades for improved soil penetration and cutting.

The equipment is preferably attached to the three-point-linkage of a tractor, and in this case only one road wheel may be provided at its rear end, which serves to revolve the gear-and-auger assembly. The gear and augers are driven from the power-take-off via a power train commprising a driveshaft and universal joints, or by a hydraulic pump and motor.

In a modified embodiment the carriage has two rear wheels and is drawn by a traction vehicle by means of a draw-bar which also supports it at the correct height. This embodiment is provided with an I.C.-engine mounted on the carriage and transmitting the power to the auger by hydraulic or mechanical transmission means.

With a view to better utilizing the I.C.-engine, two augers are preferably mounted on the revolving gear transmission on concentric, but opposed shanks. The lengths of the augers is predetermined by the depth to which the holes are to be drilled, and in contradistinction to the known drilling machines, the drill is not lowered into, or raised out of the soil, and it is understood that augers of different lengths may be mounted on the gear transmission for obtaining holes of different depth.

The equipment, while drawn across a field, drills equidistant holes, one after the other, by the action of the augers which enter the soil at a forward angle of inclination of the auger axis, gradually penetrate to the full depth owing to their rearward motion relative to the carriage's progress in forward direction. The auger leaves the soil at a rearward angle of inclination equal to the angle of entry. The ratio of the chain gear connecting the auger assembly to the road wheel can be changed to render the tip speed of the augers equal, larger or smaller than the speed of the equipment across the field, with a view of obtaining substantially cylindrical or oblong holes in the ground.

With a view to ensure the desired revolving motion of the auger assembly at the time of each auger entering the soil and to prevent slipping of the road wheel due to heavy soil resistance, one pointed blade each is fastened to the revolving gear transmission at a forward angle relative to the auger axis. The point enters the soil just ahead of the auger's tip, and during the forward motion of the equipment the blade is gripped by the soil and thus assists in revolving the auger assembly at the required speed. In the case of two augers, two blades will be provided in opposite alignment, each cutting into the soil just before entry of the respective auger tip.

It will be understood that the holes drilled by this equipment are not of exactly cylindrical shape as with stationary drilling, but since holes for the planting of trees or fence posts are not of great depth, usually less than 0.5 m, this is of no importance for the intended task. On the other hand, the speed attained by drilling during uninterrupted travel of the equipment is so much higher than by drilling with conventional equipment, that the invention brings with it enormous advantages, saving both working hours and initial investment in respect of a given amount of drilling work per hour.

SHORT DESCRIPTION OF THE DRAWINGS

FIG. 1 is a side view of a drilling equipment attached to a tractor and supported by a single road wheel on one side, FIG. 2 is a top view of the equipment illustrated in FIG. 1, FIG. 3 is a side view of a two-wheeled drilling equipment suitable for traction by a vehicle and provided with an I.C.-engine as power unit, FIG. 4 is a top view of the drilling equipment illustrated in FIG. 3, and FIG. 5 is a vertical section through a bore hole showing an auger during its operation.

DETAILED DESCRIPTION

FIGS. 1 and 2 illustrate, on general lines, drilling equipment attached to the three-point-linkage of a tractor, deriving its power from the tractor engine through its power-take-off. The working parts are carried on a carriage comprising a rectangular frame 1 supported at its rear end by a single road wheel 2, the wheel being provided with external transverse spikes 3 for better gripping of the ground without slipping. A vertical post 4 extending upwardly from the front end of the frame serves for attachment of the upper arm 5 of the linkage of a tractor 10, while the two lower linkage arms are pivotally connected to the front cross member 7 of the frame 1. The working components comprise two coaxial and opposedly positioned augers, each comprising a shaft 10, 10' with double-helical blades 11, 11', ending in cutting lips 12, 12'. The helices and the cutting lips of the two augers are respectively right- and left-oriented, for the following reason: The auger shafts are attached to the two-ended output shaft of a bevel gear 13 located in a gear box 14, the latter being revolvable in bearings 15 mounted on the frame 1 perpendicular to the direction of travel as indicated by the arrow F. The bevel gear is rigidly fastened on this shaft 16 which transmits the torque to the two augers, in the same sense of rotation; for this reason the augers have respective left and right helical orientation, since they attack the soil in alternate senses. The bevel gear is rotated by means of a gear 17 positioned in a gear box which in its turn is firmly attached to the frame and is stationary. The rotary power is obtained from the power-take-off 19 through a power train 20 comprising two universal joints and a drive shaft. The auger assembly, i.e. the gear box 14, together with the augers, is revolved in the direction of the arrow R about a horizontal axis which is perpendicular to the direction of travel, by the forward travelling motion of the road wheel 2. Transmission means between wheel 2 and the auger assembly is in the form of a chain gear, comprising a driving sprocket wheel 21 mounted on the rotating axle of the road wheel, a driven sprocket wheel 22 mounted on the gear box 14, and a connecting chain 23. The sprocket 21 is exchangeable with a view to altering the ratio between the rotational speed of the road wheel and that of the auger assembly and a releasable coupling serves to connect and disconnect the chain drive and the wheel.

In order to facilitate the entry of the augers into—sometimes very hard—soil and to ensure the revolving motion of the auger assembly, two blades 30 and 30', preferably in the shape of cultivator blades, are rigidly fastened to the gear box, between the two augers which, revolving together with the assembly, penetrate the soil prior to the entry of the augers and before their starting to drill a hole.

The outer edges of the helical auger blades are studded with teeth 25 of a hard, wear-resisting material such as special tool steel, special alloyed steel or the like, thereby improving the drilling operation and preventing early wear of the auger blades.

The tractor serves to pull the hole driller across a field, while the height of the augers above ground level can be adjusted by lengthening or shortening the tractor link 5. By means of this linkage the implement can be lifted off the ground for transport from site to site.

Figure 1:
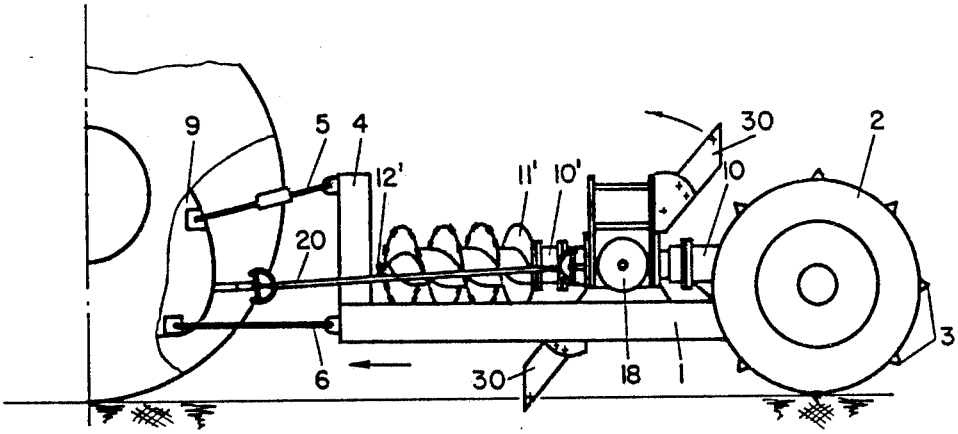
Figure 2:
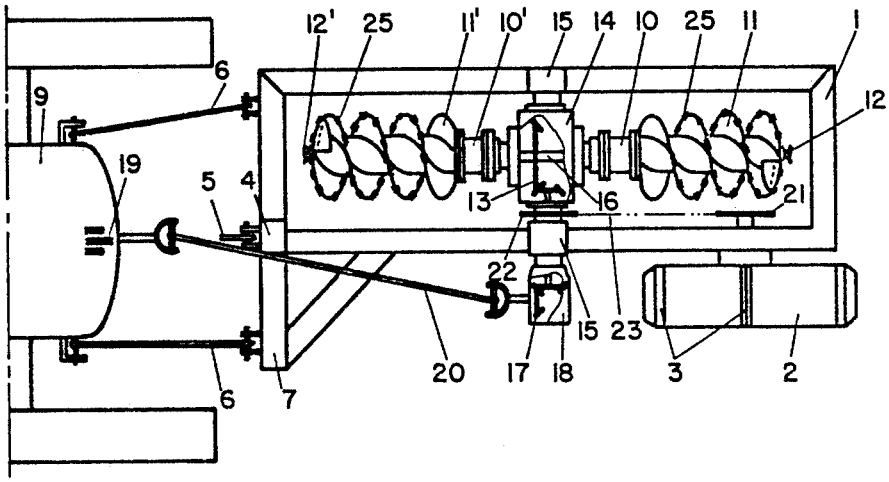
Figure 3:
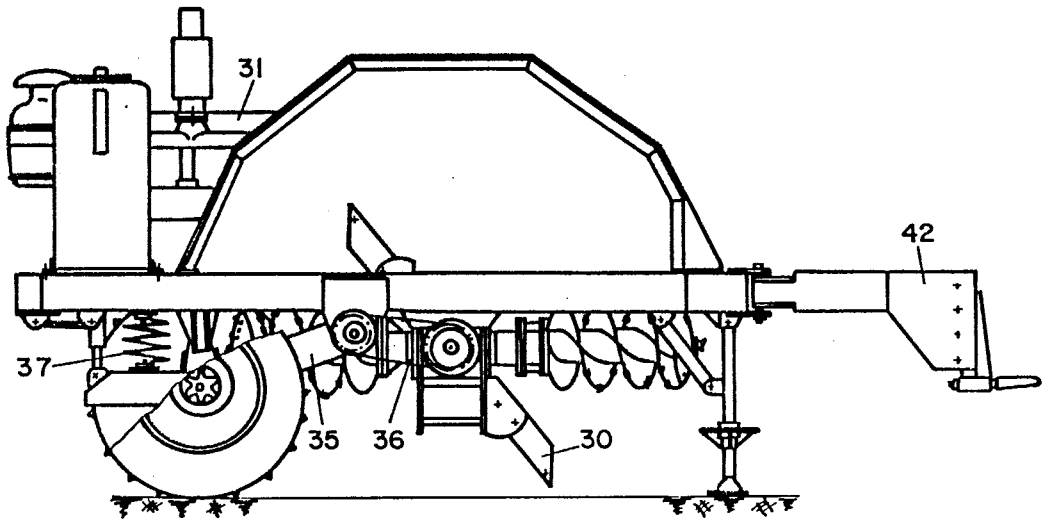
FIGS. 3 and 4 illustrate a second embodiment of the invention, which comprises an I.C.-engine for the purpose of supplying the power for the drilling operation of the augers, and which is adapted to be drawn by any traction vehicle including a tractor.
Figure 4:
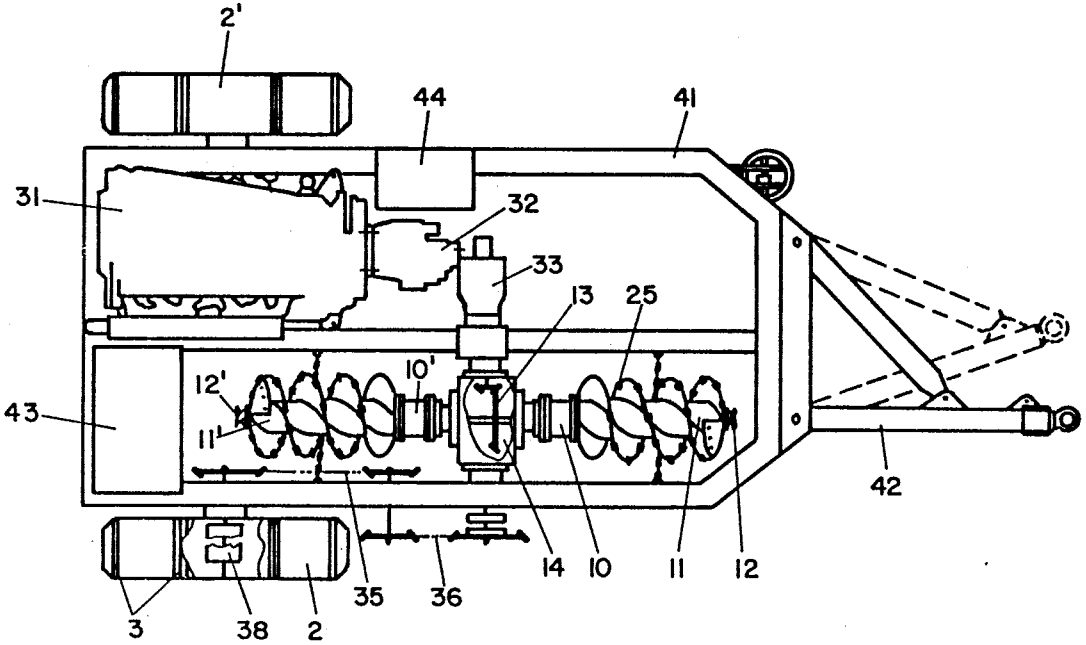
Figure 5:
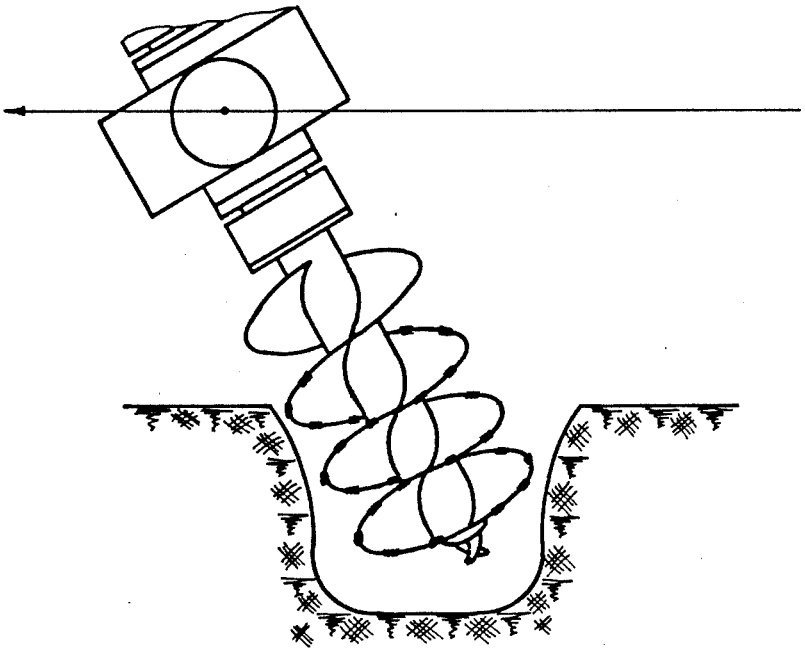
FIG. 5 shows the process of a hole being drilled during the movement of an auger from its first moment of entry to its exit out of the hole. This figure also shows that the hole approaches cylindrical shape, with a flared opening, a shape particularly suitable for the planting of trees.

The operating components, i.e. the augers and blades as well as their driving mechanism are identical with those shown in FIGS. 1 and 2, and are, therefore, denoted by identical numerals. The main difference lies in the provision of the I.C.-engine 31, the transmission of power from the engine to the augers assembly, and the construction of the carriage. A hydraulic pump 32 is coupled to the engine 31, which supplies pressurized liquid to a hydraulic motor 33 directly coupled to the gear transmission 13. The auger revolutions are readily adjustable by either adjusting the engine speed or by throttling the liquid supply.

The revolutions of the auger assembly are obtained from one of the roadwheels by way of a double chain-drive 35 and 36. The chain drive 35 is provided to permit free motion of the road wheel, which is supported by helical springs 37, without undue tension of the chain drive. In addition, a releasable clutch 38 serves to engage and to disengage the chain drives, during drilling operations and road transport, respectively.

The carriage of this embodiment is much wider than that of the embodiment of FIGS. 1 and 2 as it serves to support the power unit as well. It comprises a frame 41 consisting of three longitudinal members and two cross members, and is supported in its rear portion by two road wheels 2 and 2'. A draw-bar 42 is pivotally attached to the front end by means of vertical pivot means permitting its being secured in two alternate positions: a position A in line with the auger axis, in which the carriage is pulled during hole drilling, and a position B central in relation to the wheels 2 and 2', in which the carriage is pulled during road transport. Additional equipment shown in the drawings are: a fuel tank 43, and an oil reservoir 44.

The drilling operation is similar to that of the equipment of FIGS. 1 and 2, except for the fact that power for drilling is derived from the engine 31 by way of the hydraulic pump and motor.

It will be understood that instead of the hydraulic transmission, mechanical torque transmission may be provided between engine and gear. As an alternative, each auger may be rotated separately by a hydraulic motor attached to its shaft, which would dispense with the gear 13 and the gearbox 14. As another alternative the engine 31 may be utilized for rotating the auger assembly about its axis, preferably by the addition of a hydraulic motor fixedly mounted on the chassis frame, transmission being direct or through a gear transmission; control of the motor revolutions could be obtained by electronic circuit means monitored by the speed of the road wheels, viz. the speed of travel of the equipment. This arrangement would make the chain transmissions and the clutch redundant.

Instead of two augers, only one auger or more than two could be mounted on a rotating body, in the above case the gearbox, but it appears that two augers give the best results regarding speed of drilling and control.

As a third alternative, it is proposed to utilize the pressurized liquid generated by the hydraulic system of the tractor itself, and to install hydraulic motors both for revolving the auger assembly, and for rotating the augers about their axes for drilling. In this case it may be necessary to choose a tractor of slightly bigger size, but is is evident that this arrangement would mean fewer mechanical components, more efficient control of the different rotational speeds, and ready adaptation to the conditions of the soil and the land formation.

We claim:

1. Equipment for drilling a row of substantially equidistant holes in soil, comprising:

a carriage attached to a traction vehicle for moving said traction vehicle along a predetermined path, said carriage being supported by at least one road wheel, at least one earth auger compriising a shaft and helical blades wound around said shaft, and cutting lips extending from an outer end of said shaft, said shaft being power-rotated about its central axis and fastened to said carriage by means of a substantially horizontal, revolvable axle, said axle being positioned substantially perpendicular to the direction of travel of said equipment at a predetermined height above ground level and being coupled to revolve said auger in a substantially vertical plane sustantially parallel to said direction of travel, the depth of said drilled holes being defined by the distance of the outer end of said shaft of said auger from the axis of said axle, at least one cultivator-shaped blade mounted on said substantially horizontal rotatable axle, forward of said at least one auger, for loosening the soil before entry of said cutting lips of said auger into the soil, a power source and transmission coupled to rotate said auger about its central axis, and means for revolving said at least one auger about said substantially horizontal axle so that the rotational speed of said auger is a function of the travel speed of said equipment.

2. The equipment of claim 1, wherein said at least one roadwheel is provided with spikes on its circumference for preventing slipping of sadi roadwheel on the soil.

3. The equipment of claim 1, comprising hydrualic transmission means coupled between an hydrualic pressure supply of said traction vehicle and said at least one auger and said substantially horizontal axle revolving said augers in a substantially vertical plane.

4. The equipment of claim 1, wherein the outer edges of said helical auger blades are studded with teeth of a hard, wear-resisting material.

5. The equipment of claim 1, further comprising means for attachment to a three-point-linkage of a tractor.

6. The equipment of claim 5 further comprising mechanical transmission means coupled between a power-take-off of said tractor and said bevel gear on said substantially horizontal axle.

7. The equipment of claim 1, further comprising a carriage supported by two roadwheels which are attached to a rear portion of said carriage, said carriage being provided with a drawbar serving for attachment to a traction vehicle.

8. The equipment of claim 1, comprising a drawbar adapted to be positioned centrally in respect to said two roadwheels.

9. The equipment of claim 7 further comprising an internal combustion engine mounted on said carriage, and power transmission means coupling said engine to said axle and said bevel gear.

10. The equipment of claim 7, comprising a drawbar adapted to be positioned substantially in line with the plane of rotation of said augers.

11. The equipment of claim 1, comprising two of said augers fastened to said substantially horizontal axle in co-axial and opposite alignment.

12. The equipment of claim 11, comprising two of said cultivator-shaped blades mounted on said substantially horizontal rotatable axle, each cultivator-shaped blade being mounted forward of a respective one of said two augers.

13. The equipment of claim 11, comprising a bevel gear mounted on said substantially horizontal axle having an input shaft operationally connected to a power source and an output shaft substantially perpendicular to said input shaft and coaxially coupled to the shafts of said two augers.

14. The equipment of claim 13, further comprising transmission means coupling said at least one roadwheel to said substantially horizontal axle for revolving said axle at a rotational speed which is a function of the forward speed of said equipment.

15. The equipment of claim 13 further comprising mechanical transmission means coupled between a power-take-off of said tractor and said bevel gear on said substantially horizontal axle.

16. The equipment of claim 13 further comprising an internal combustion engine mounted on said carriage, and power transmission means coupling said engine to said axle and said bevel gear.

17. The equipment of claim 16, wherein said power transmission means is a hydraulic transmission.

18. The equipment of claim 16, wherein said power transmission means is a mechanical transmission.

* * * * *